US008197249B1

(12) United States Patent
Nguyen

(10) Patent No.: US 8,197,249 B1
(45) Date of Patent: Jun. 12, 2012

(54) FULLY PREMIXED LOW EMISSION, HIGH PRESSURE MULTI-FUEL BURNER

(75) Inventor: Quang-Viet Nguyen, Richmond Heights, OH (US)

(73) Assignee: The United States of America, as represented by the Administrator of the National Aeronautics and Space Administration, Washington, DC (US)

( * ) Notice: Subject to any disclaimer, the term of this patent is extended or adjusted under 35 U.S.C. 154(b) by 1397 days.

(21) Appl. No.: 11/412,935

(22) Filed: Apr. 28, 2006

(51) Int. Cl.
*F23N 1/02* (2006.01)

(52) U.S. Cl. ..... 431/12; 60/737; 60/738

(58) Field of Classification Search ..... 431/12, 431/181, 187; 239/11; 60/737, 738
See application file for complete search history.

(56) References Cited

U.S. PATENT DOCUMENTS

| | | | | | |
|---|---|---|---|---|---|
| 4,764,105 | A * | 8/1988 | McElroy | 431/115 |
| 4,830,600 | A | 5/1989 | VerShaw et al. | 431/8 |
| 4,928,481 | A * | 5/1990 | Joshi et al. | 60/737 |
| 5,112,219 | A * | 5/1992 | Hiemstra | 431/354 |
| 5,375,998 | A * | 12/1994 | Witteveen | 431/328 |
| 5,408,830 | A | 4/1995 | Lovett | 60/737 |
| 5,573,395 | A | 11/1996 | Althaus et al. | 431/278 |
| 5,865,616 | A | 2/1999 | George | 431/284 |
| 6,164,055 | A | 12/2000 | Lovett et al. | 60/39.06 |
| 6,267,585 | B1 * | 7/2001 | Suttrop | 431/354 |
| 6,267,912 | B1 * | 7/2001 | Hershkowitz et al. | 252/373 |
| 6,446,439 | B1 | 9/2002 | Kraft et al. | 60/739 |
| 6,561,795 | B1 | 5/2003 | Lasagni et al. | 431/354 |
| 6,746,236 | B2 | 6/2004 | Kuriyama et al. | 431/354 |
| 6,884,460 | B2 * | 4/2005 | Ackerman et al. | 427/229 |
| 7,094,049 | B2 * | 8/2006 | Mizuno et al. | 431/350 |
| 2002/0011070 | A1 | 1/2002 | Mandai et al. | 60/725 |
| 2002/0127504 | A1 * | 9/2002 | Neville et al. | 431/1 |
| 2002/0194851 | A1 | 12/2002 | Stalder et al. | 60/776 |
| 2003/0148241 | A1 | 8/2003 | Shimazu et al. | 431/354 |
| 2004/0000146 | A1 * | 1/2004 | Inoue et al. | 60/776 |
| 2005/0003317 | A1 * | 1/2005 | Mizuno et al. | 431/345 |

* cited by examiner

*Primary Examiner* — Kenneth Rinehart
*Assistant Examiner* — Jorge Pereiro
(74) *Attorney, Agent, or Firm* — Squire Sanders; Robert H. Earp, III

(57) ABSTRACT

A low-emissions high-pressure multi-fuel burner includes a fuel inlet, for receiving a fuel, an oxidizer inlet, for receiving an oxidizer gas, an injector plate, having a plurality of nozzles that are aligned with premix face of the injector plate, the plurality of nozzles in communication with the fuel and oxidizer inlets and each nozzle providing flow for one of the fuel and the oxidizer gas and an impingement-cooled face, parallel to the premix face of the injector plate and forming a micro-premix chamber between the impingement-cooled face and the in injector face. The fuel and the oxidizer gas are mixed in the micro-premix chamber through impingement-enhanced mixing of flows of the fuel and the oxidizer gas. The burner can be used for low-emissions fuel-lean fully-premixed, or fuel-rich fully-premixed hydrogen-air combustion, or for combustion with other gases such as methane or other hydrocarbons, or even liquid fuels.

22 Claims, 9 Drawing Sheets

$\phi = 3.2$ $\phi = 1.0$ $\phi = 0.6$

FULLY PREMIXED LOW EMISSION, HIGH PRESSURE MULTI-FUEL BURNER

ORIGIN OF THE INVENTION

The invention described herein was made by employees of the United States Government and may be manufactured and used by or for the Government for Government purposes without payment of any royalties thereon or therefore.

BACKGROUND OF THE INVENTION

1. Field of Invention

The present invention relates to systems for burning gases to provide power or propulsion. In particular, the present invention is directed to systems that can operate in a fully-premixed mode at high pressures, with low pressure losses, and without flashback problems. In specific embodiments, the invention allows for operation in fuel-lean fully-premixed regime and avoids combustion from occurring at stoichiometric fuel-oxidizer contours that result from imperfect mixing.

2. Description of Related Art

The idea of using hydrogen as a fuel for gas turbine combustion is not new, but to make such a system that can operate in a fuel-lean fully-premixed mode at high pressures, with low pressure losses, and without flashback problems has not been solved by the prior art. Operation in the fuel-lean fully-premixed regime avoids combustion from occurring at stoichiometric fuel-oxidizer contours that result from imperfect mixing. Flames at stoichiometric contours have a high flame temperature, thus they produce more $NO_X$ (oxides of nitrogen) pollution due to the thermal $NO_X$ mechanism.

One design that provides a fully-premixed hydrogen-air flame at high pressure utilizes a water-cooled sintered metal disk as the burner element. An example of such a burner is a 'McKenna burner,' manufactured by Holthuis & Associates. The small pore sizes of the porous disk of that burner act as a flashback arrester, which prevents the flame from flashbacking upstream. However, this design requires water cooling to remove the heat from the flame in order to not melt. The water cooling also removes substantial amounts of heat from the flame, making the flame temperature low, which reduces the amount of work the hot gases can provide. Furthermore, this design suffers from high pressure losses making it unsuitable for use in gas turbine applications where pressure losses greater than typically 7% cannot be tolerated.

Another design that attempts to provide a fully-premixed hydrogen-air flame utilizes small hydrogen jets impinging on the main airflow in a 'cross-flow' arrangement. In such a design, the main airflow enters a circular duct where multiple (typically 2 to 4) hydrogen gas jets are injected from the wall of the duct radially inwards to the center of the duct. By allowing sufficient distance downstream of the injection point for hydrogen to mix with the air flow before it combusts, a lean premixed system can be realized. However, the problem with this design is that the bulk mixing of the cross-flow hydrogen jets is not complete by the time the mixture burns downstream in a sudden-expansion stabilized combustion zone. Due to the incomplete mixing, this design does not achieve the lowest theoretically permissible levels of $NO_X$ emissions since the flame zones sometimes form where there are stoichiometric fuel-air contours that resulted from the incomplete mixing.

Operation in the fuel-lean fully-premixed regime is desirable in order to enable a combustor that produces as little thermal $NO_X$ as possible. However, at high pressures, operating a hydrogen-air mixture in a fully-premixed mode has caused thermal meltdown problems in prior art burners due to flashback that causes the flame to anchor upstream of the burner face, thus destroying the burner from the inside.

So the objective is to design a burner that can operate in the fuel-lean fully-premixed mode, yet not suffer from flashback and has a good operability over a wide range of flow conditions, all the while the burner needs to have as little pressure loss as possible and be easy to use and manufacture. However, the requirement of successful operation in a fuel-lean fully-premixed mode does not preclude this combustor design from operating in a fuel-rich fully-premixed mode.

SUMMARY OF THE INVENTION

According to one embodiment of the invention, a low-emissions high-pressure multi-fuel burner includes a fuel inlet, for receiving a fuel gas, an oxidizer inlet, for receiving an oxidizer gas, an injector plate, having a plurality of nozzles that are aligned with premix face of the injector plate, the plurality of nozzles in communication with the fuel and oxidizer inlets and each nozzle providing flow for one of the fuel gas and the oxidizer gas and an impingement-cooled face, parallel to the premix face of the injector plate and forming a micro-premix chamber between the impingement-cooled face and the in injector face. The fuel gas and the oxidizer gas are mixed in the micro-premix chamber through impingement-enhanced mixing of flows of the fuel gas and the oxidizer gas.

Additionally, the impingement-cooled face may cause the flow of one gas of the fuel and oxidizer gases to turn 90° and mix into the other gas of the fuel and oxidizer gases at a direction that is perpendicular to the flow of the other gas, where that the one gas may be the oxidizer gas. The burner may also include final exit jet nozzles, where the final exit jet nozzles are coaxial with at least some of the plurality of nozzles.

Additionally, the plurality of nozzles may be staggered in their placement on the injector plate and may be positioned in an array pattern on the injector plate. The fuel gas may be hydrogen gas and the oxidizer gas may be air and the burner may be configured burn the hydrogen and air without flashback. The burner may be configured to produce approximately zero $NO_X$ in the burning of the fuel and oxidizer gases. The impingement-cooled face may be composed of oxygen-free copper or other high temperature alloys.

According to another embodiment, a method of burning fuels at low-emissions and high-pressure includes the steps of receiving a fuel gas at a fuel inlet, receiving an oxidizer gas at an oxidizer inlet, providing the fuel and oxidizer gases to a plurality of nozzles of an injector plate, with the plurality of nozzles being aligned with premix face of the injector plate, with different nozzles receiving the fuel and oxidizer gases and mixing the fuel and oxidizer gases in a micro-premix chamber, formed between the injector plate and an impingement-cooled face, through impingement-enhanced mixing of flows of the fuel and oxidizer gases. The impingement-cooled face causes the flow of one gas of the fuel and oxidizer gases to turn 90° and mix into the other gas of the fuel and oxidizer gases at a direction that is perpendicular to the flow of the other gas.

According to another embodiment, a system for burning fuels at low-emissions and high-pressure includes first receiving means for receiving a fuel gas at a fuel inlet, second receiving means for receiving an oxidizer gas at an oxidizer inlet, providing means for providing the fuel and oxidizer gases to a plurality of nozzles of an injector plate, with the plurality of nozzles being aligned with premix face of the injector plate, with different nozzles receiving the fuel and oxidizer gases and mixing means for mixing the fuel and oxidizer gases in a micro-premix chamber, formed between the injector plate and an impingement-cooled face, through impingement-enhanced mixing of flows of the fuel and oxidizer gases. The impingement-cooled face causes the flow of one gas of the fuel and oxidizer gases to turn 90° and mix into the other gas of the fuel and oxidizer gases at a direction that is perpendicular to the flow of the other gas.

These and other variations of the present invention will be described in or be apparent from the following description of the preferred embodiments.

BRIEF DESCRIPTION OF THE DRAWINGS

For the present invention to be easily understood and readily practiced, the present invention will now be described, for purposes of illustration and not limitation, in conjunction with the following figures.

DETAILED DESCRIPTION OF PREFERRED EMBODIMENTS

A novel design for a fully premixed high-pressure burner capable of operating on a variety of gaseous fuels and oxidizers, including hydrogen-air mixtures, with a low pressure drop ($\Delta P/P<7\%$) is described. The burner provides a rapidly and uniformly mixed fuel-oxidizer mixture that is suitable for use in a fully-premixed combustion regime that has the benefits of low pollutant emissions (when operated at fuel lean conditions) and freedom from: harmful flashback effects, combustion instabilities, and thermal meltdown problems that are normally associated with premixed hydrogen combustion systems operating at high pressures.

The burner has been demonstrated to operate on hydrogen-air mixtures at pressures as up to 30 bar, and at equivalence ratios (Phi) ranging from 0.15 to 5.0, but typically at equivalence ratios below 0.6 or above 2.0 for extended periods of time. The burner has also been demonstrated to work well with hydrogen-carbon monoxide fuel mixtures in a 1:1 mixture (by volume). The burner design provides a uniform zone of combustion products and temperatures, and is able to achieve complete and rapid mixing of the reactant gases over a distance as short as 5 mm, with the combustion products reaching a fully-reacted state within about 10 mm downstream of the burner face.

Furthermore, the design of the burner is simple and straightforward to manufacture using conventional techniques. The modular design of the burner lends itself to scalability for larger power output applications. Finally, the burner is simple to operate and is robust for use in an industrial setting such as low-emissions stationary gas turbine engine, or for aircraft gas turbine engines.

A ultra-low emissions hydrogen fueled combustor capable of operating in a fuel-lean fully-premixed regime without the problems of flashback and thermal meltdown is highly desirable for many industrial and commercial applications. These include: stationary gas turbine engines, aircraft gas turbine engines, process gas heaters, chemical processing, process gas after burners, kiln or furnace burners, utility boiler burners, gas reforming burners, fuel cell processing burners, etc.

Figures 1A, 1B:
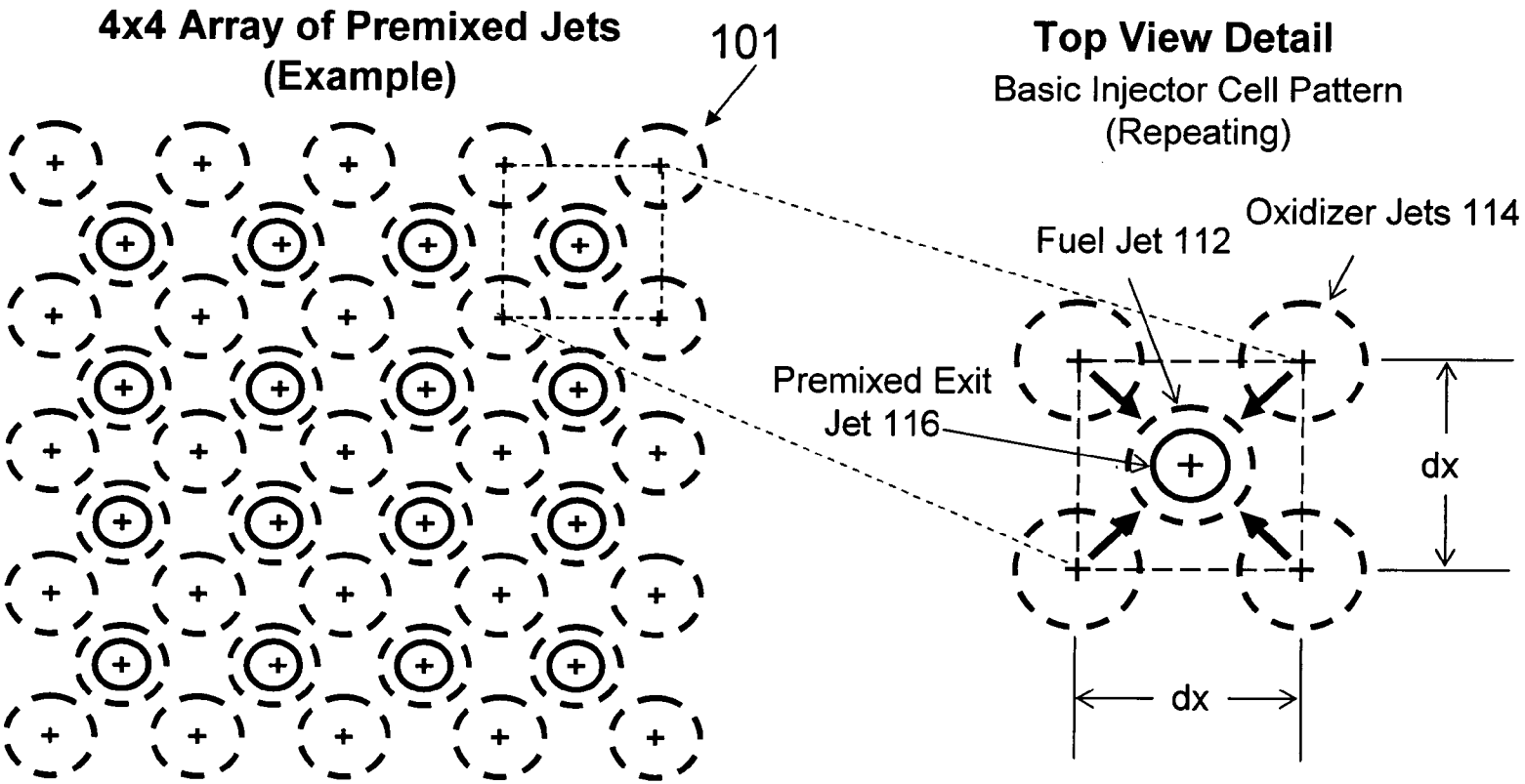
FIG. 1 shows a schematic of the staggered fuel and oxidizer jet arrangement, with FIG. 1(*b*) providing a detailed view of a section of the arrangement provided in FIG. 1(*a*) according to one embodiment of the present invention.

FIG. 1 shows a schematic of the staggered fuel and oxidizer jet arrangement that accomplishes the rapid mixing of the fuel and air flows while simultaneously providing impingement cooling to the burner face. In the present design, by using high shear forces that arise from causing the airflow to undergo a stagnation point flow that mixes perpendicularly to a hydrogen jet, rapid and complete mixing of the fuel and air is attained over a very short distance (typically less than 10 mm). In order to accomplish the rapid mixing, a square array of air jets 114 is directed to a perforated plate 101 (which also serves as the burner face) in a staggered fashion so that the air jets impinge on the solid parts of the perforated plate. Simultaneously, the fuel is directed using a square array of jets 112 that are staggered from the air jets so that the fuel is directed through the holes of the perforated plate.

The fuel jets 112 are coaxial with the exit mixture jets 110; whereas the oxidizer jets 114 are offset to first impinge on the backside of the burner face before mixing with the fuel stream. The spacing between the fuel or oxidizer jets is dx, with the offset between the fuel and oxidizer jets as dx/2, according to one embodiment. As an alternate embodiment, the fuel and oxidizer flow paths can be reversed so that the oxidizer is coaxial with the exit jet. This may have the added benefit of providing enhanced impingement cooling effects since fuels such as gaseous hydrogen ($H_2$) has a high thermal conductivity compared to air. The top view detail (FIG. 1(*b*)) shows the basic injector cell pattern which requires four quadrants of the oxidizer jets shown (circumscribed by the dashed square box) which flow towards the fuel jet to enable the rapid mixing.

Figures 2A, 2B:
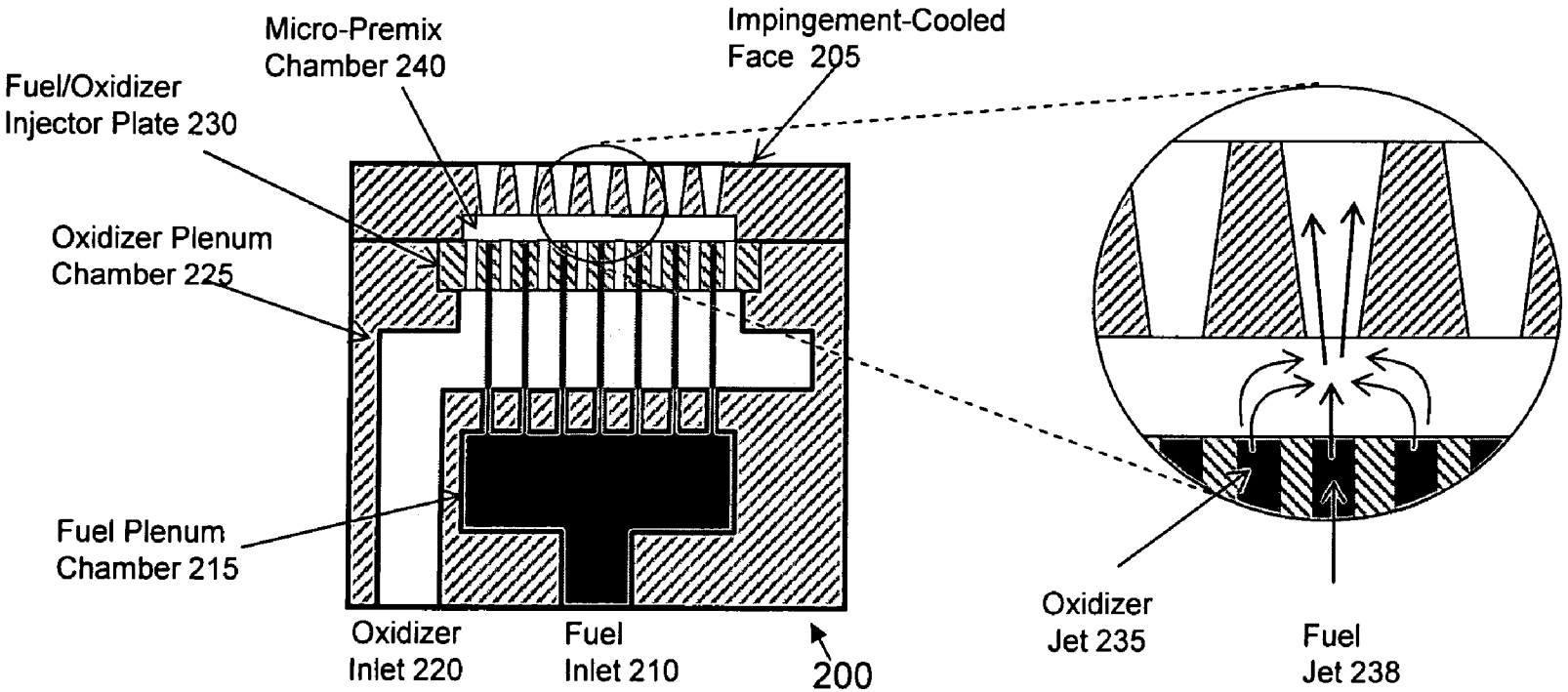
FIG. 2 provides an schematic of a burner, with FIG. 2(*b*) providing a detailed view of a section of the burner illustrated in FIG. 2(*a*) according to one embodiment of the present invention.

FIG. 2 provides a schematic of fully-premixed burner design with backside impingement cooling flow arrangement. The fuel inlet 210 provides fuel to the fuel plenum chamber 215, which ultimately supply the fuel jets 238. The oxidizer inlet 220 supplies oxidizer to the oxidizer plenum chamber 225. both oxidizer and fuel jets are fed through the fuel/oxidizer injector plate 230. The fuel jets 238 are coaxial with the burner face orifice holes, whereas the oxidizer jets 235 are staggered with respect to the fuel jets and form a stagnation point flow with the backside of the burner face to effect the impingement cooling. As shown on the enlarged detail on in FIG. 2(*b*), the oxidizer jets radially impinge on the fuel jets to perform a rapid and effective mixing process, in the micro-premix chamber 240, to achieve a homogeneous fuel-air mixture by the time the gases exit the small throat section of the burner face orifices.

The fuel flows are fed from a fuel plenum chamber 215 which leads to an array of small tubes 238 that direct the fuel flow to the injector plate 230. The tubes are brazed to the fuel tube plate and then press-fitted into the injector plate 230. The air flows are provided by a toroidal plenum 225 which radially directs the air flows into the air pre-chamber which surrounds the fuel tube bundles. The air flow then exits jets 235 that are offset from the fuel jets 238 through the injector plate 230. The fuel and air flows then rapidly mix in the thin micro-premixing chamber 240 provided by the 0.050 in thick gap between the burner face 205 and the injector plate 230. The premixed fuel and air mixture then exits through the jets located in the burner face and react and burn downstream. Parts of the apparatus are made of copper for ease of drilling, although the burner face has also been fabricated using stainless steel with success. All other parts are fabricated with stainless steel using conventional machining techniques. Other high temperature alloys such as Hastalloy™ (Has-X), an alloy which exhibits excellent resistance to corrosion, and is an excellent candidate for repair or rebuild of equipment intended for use in and susceptible to highly corrosive environments, or Inconel™, can also be employed. The face can be coated with a ceramic-spray-deposited 'Temperature Barrier Coating' (or TBC). In an alternate embodiment, a TBC coating on Hastalloy™ is used, where the TBC coating increases the temperature rating of the face typically by 100 F and increases longevity by preventing metal oxidation at high temperatures.

As shown in FIG. 2, as both gas streams flow, they have to exit the same holes in the perforated plate 205, it is this constriction of the flows, coupled with the requirement that the air flow makes two 90 degree turns while impinging on the coaxial fuel flow, that forces the two gas streams to mix in an extremely efficient manner. The gas mixture has to increase its flow velocity as it exits the burner face through the perforated holes. The conical expansion of the exit nozzle also assists in flame stability by reducing the speed of the gas flows exiting the constriction nozzle. As long as the velocity of the mixture is kept above the laminar flame speed of hydrogen-air mixtures (which can be as high as 10 m/s at high pressures), flashback will be avoided. Several advantages arise from this configuration: complete and rapid mixing, the air flow serves to provide impingement cooling of the burner face (or dome); the fuel and oxidizer are not premixed until the very last possible moment, thus increasing the safety by eliminating the possibility of upstream burning of the premixed gases. The effectiveness of the mixing is not dependent on the use of hydrogen gas, and thus, the system works well for other gaseous fuels such as methane, propane, or natural gas, in a fully-premixed mode. The design lends itself to having an inherent multi-fuel capability which is very important in industrial gas turbine combustors. The generic description of this type of burner and the flow facility are to support it for use an optical diagnostic calibration flame source.

Figure 3:
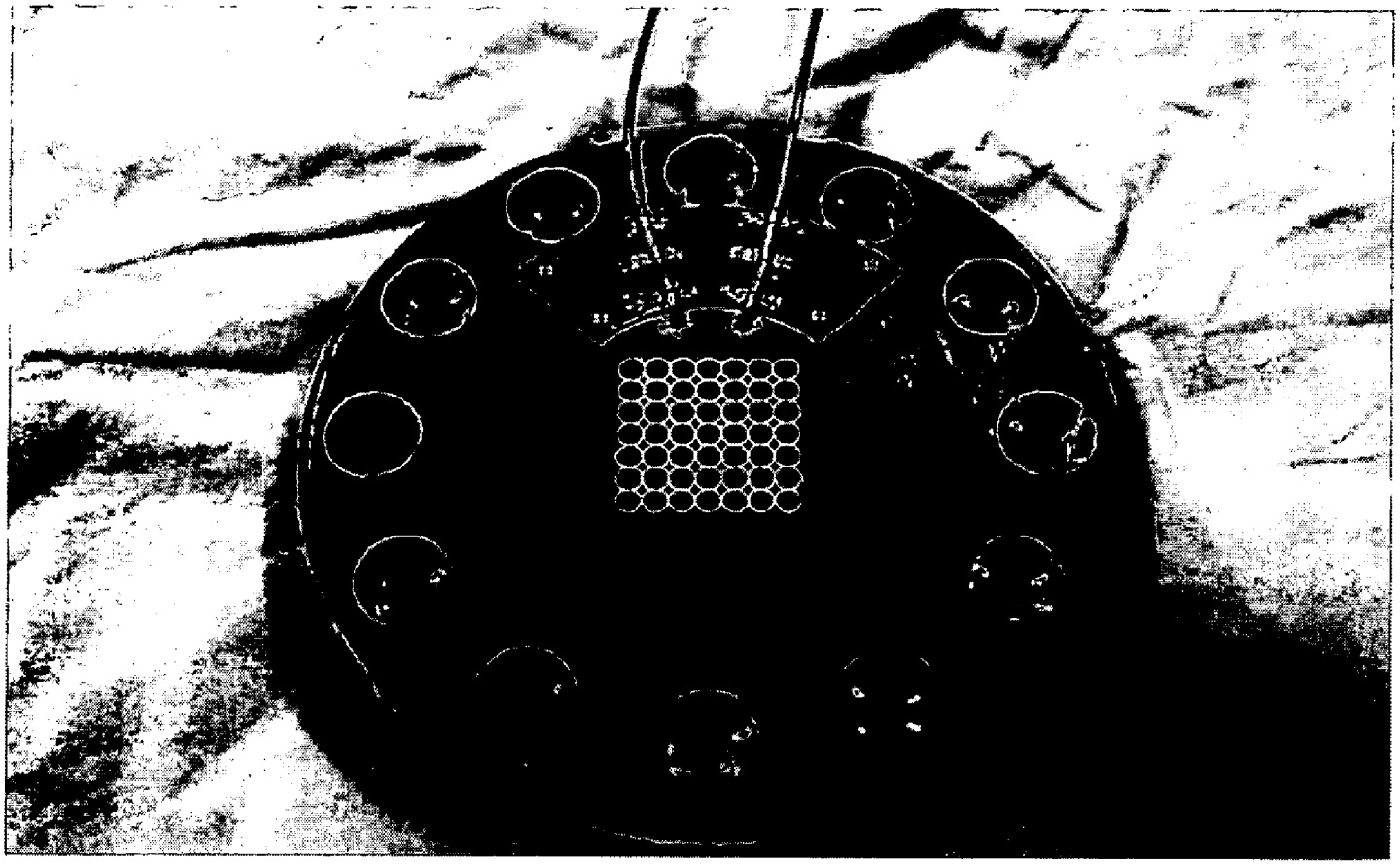
FIG. 3 provides photograph of a burner face, according to one embodiment of the present invention.

FIG. 3 shows a photograph of the burner face. The material is oxygen free copper. Also shown are thermocouple leads attached to the burner face to monitor burner face temperature during operation. The burner face measures 3.25 inches in diameter, the active burner array is approximately 0.75 inches square, according to one embodiment.

Figure 4C:
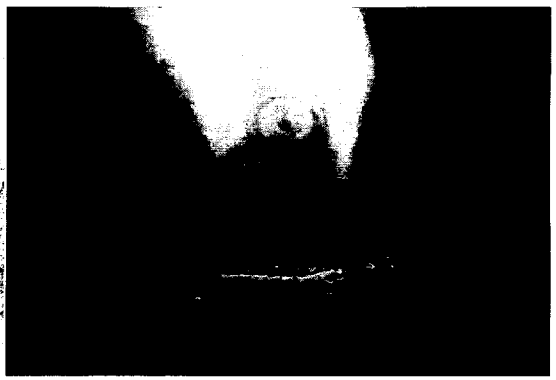
FIG. 4 provides photographs of flame configurations at equivalence ratios of 0.6, in FIG. 4(*a*), of 1.0, in FIG. 4(*b*), and of 3.2, in FIG. 4(*c*), according to certain embodiments of the present invention.
Figure 4B:
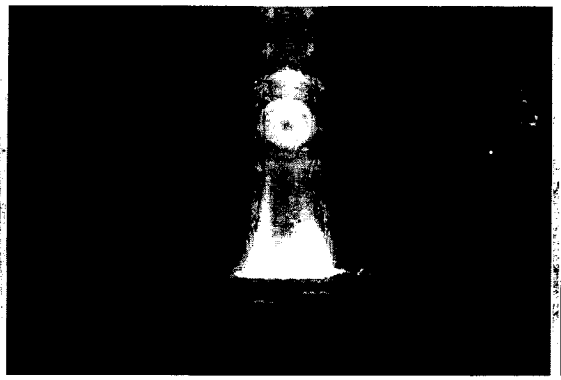
Figure 4A:
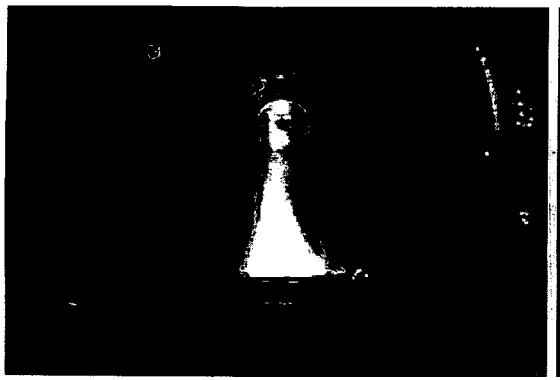

FIG. 4 shows three photographs of the burner operating on hydrogen-air mixtures at three equivalence ratios ranging from fuel-lean to fuel-rich. Note that at the stoichiometric (Phi=1.0) condition, the burner can only operate for a limited time (<2 minutes) before having to shutdown due to high temperatures (>650 C) being reached. As shown in these photographs, the combustion zone appears quite uniform and the burner itself operated in a stable and controllable fashion.

Figure 5:
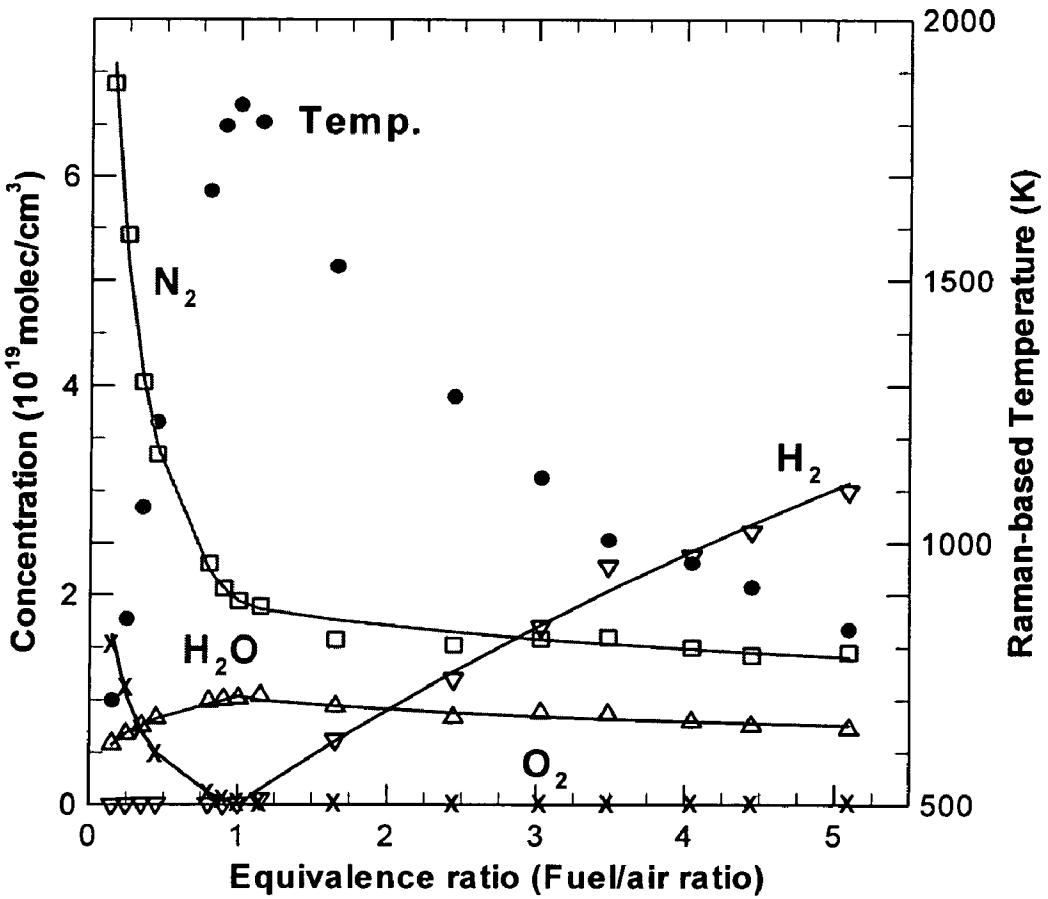
FIG. 5 illustrates a shows the quantitative multi-scalar data as a function of the equivalence ratio, according to one embodiment of the present invention

FIG. 5 shows the quantitative multi-scalar data obtained at a location 6 mm above the burner face using spontaneous Raman scattering. The Raman scattering technique used here enabled measurements of the chemical species concentration and temperatures. It is noted that the measurements compare well with predictions using chemical equilibrium at the spectroscopically measured temperature. From FIG. 5, it should also be noted that the wide operational range of the burner as it could be operated from an equivalence ratio of Phi=0.15 all the way to Phi=5.0.

Figure 6:
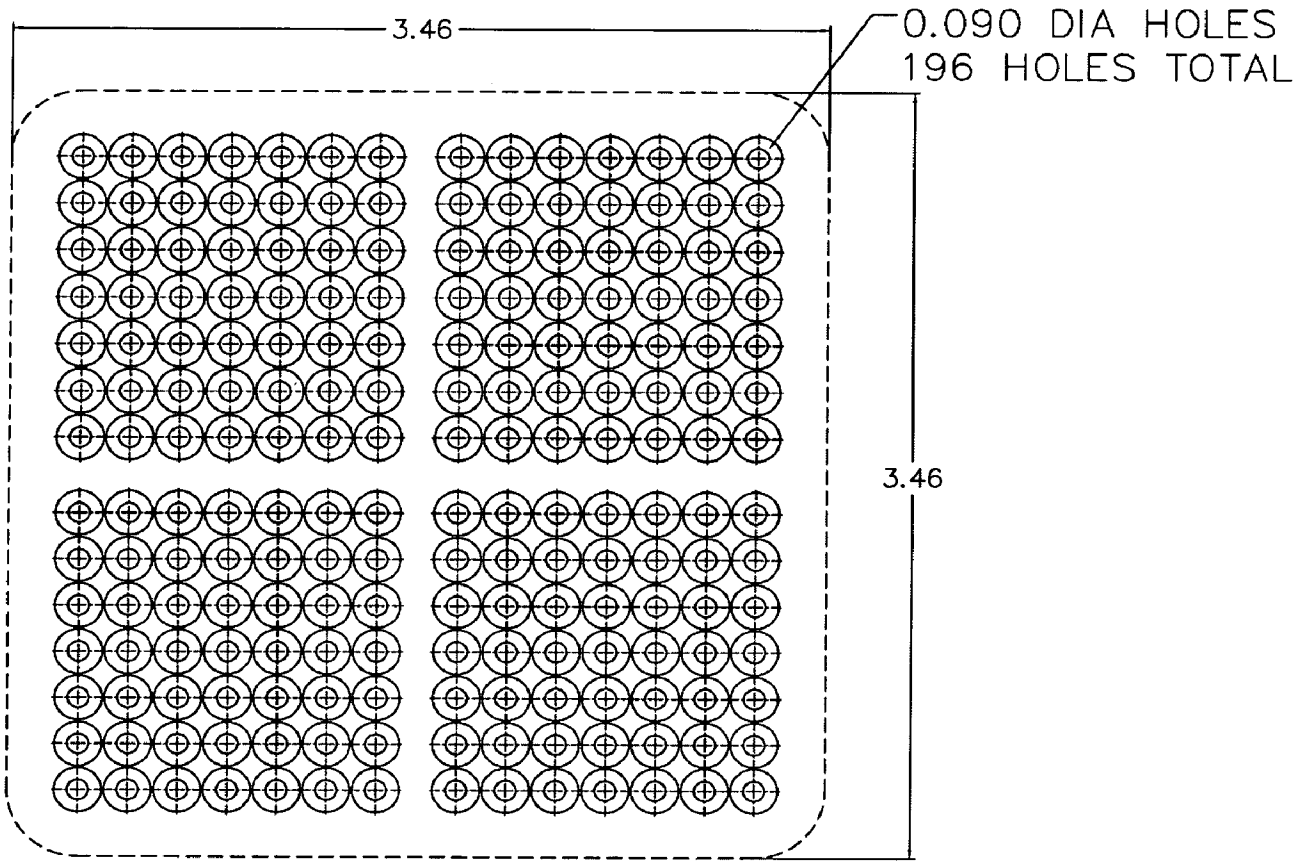
FIG. 6 illustrates an alternate embodiment of a burner as applied to a multi-cluster array to enable larger flow rates.

In alternate embodiments, this burner design may be scaled for larger overall flow rates. This can be achieved simply by repeating the 7×7 array pattern in a cluster and slightly enlarging the jet diameters to accommodate more flows with a minimal pressure drop. Such an example is shown in FIG. 6, where a 2×2 cluster of the 7×7 premixed burner jets is shown. Here a 2×2 cluster of 7×7 burner jets shown in a top view, each jet has a 0.090 in diameter that expands out in a 1:5 ratio, according to this embodiment. This design permits an overall air flowrate of about 1.33 lbm/s at 800 F and 280 psia inlet pressure with an equivalence ratio of Phi=0.30, the pressure drop for this design is about 6.5% with an approximate ACD of 0.75 $in^2$. The dimensions shown are in inches, for this embodiment.

For this particular embodiment, the flow calculations show that for a 0.090 in (2.28 mm) diameter exit jet (quantity 196) will give an ACD value of about 0.75 $in^2$, resulting in an air mass flow rate of about 1.33 lbm/s (0.60 kg/s) for an inlet air temperature of 800 F (700 K) and a pressure of 280 psia, with an approximate 6.5% pressure drop, for a gaseous $H_2$ flow rate of 0.011 lbm/s (5 gram/s) that provides an equivalence ratio of Phi=0.30. The reference air velocity for this embodiment is about 43 ft/s (13.1 m/s) which is a medium flow value for a commercial gas turbine type combustor. At this equivalence ratio, the adiabatic flame temperature calculated from chemical equilibrium would be low enough (1354 K) that almost zero $NO_X$ would be produced.

Another embodiment of this burner can utilize non-conventional fabrication techniques such as electrochemical etching and diffusion bonding of a plurality of thin plates to achieve a similar function. This is sometimes referred to as the 'macrolaminate' fabrication process. This can be done to reduce the cost of manufacturing through batch processing techniques. With this technique, very complicated channels and flow passages can be etched into individual thin metal plates that when stacked together and diffusion bonded (or brazed) serve to provide independent fuel and oxidizer flows that would then premix in an a manner shown in FIGS. 1 and 2.

Yet another embodiment of this burner can utilize the investment casting process to produce the intricate pieces and flow channels to achieve the flow geometry depicted in FIGS. 1 and 2. With the investment (or lost wax) method, a sacrificial form is produced using a wax plastic like material. The material is then surrounded by a refractory material which is then heated to extract the plastic form; metal is then poured into the refractory mold to produce the finished part(s) which can then be assembled to form the burner.

Figure 7:
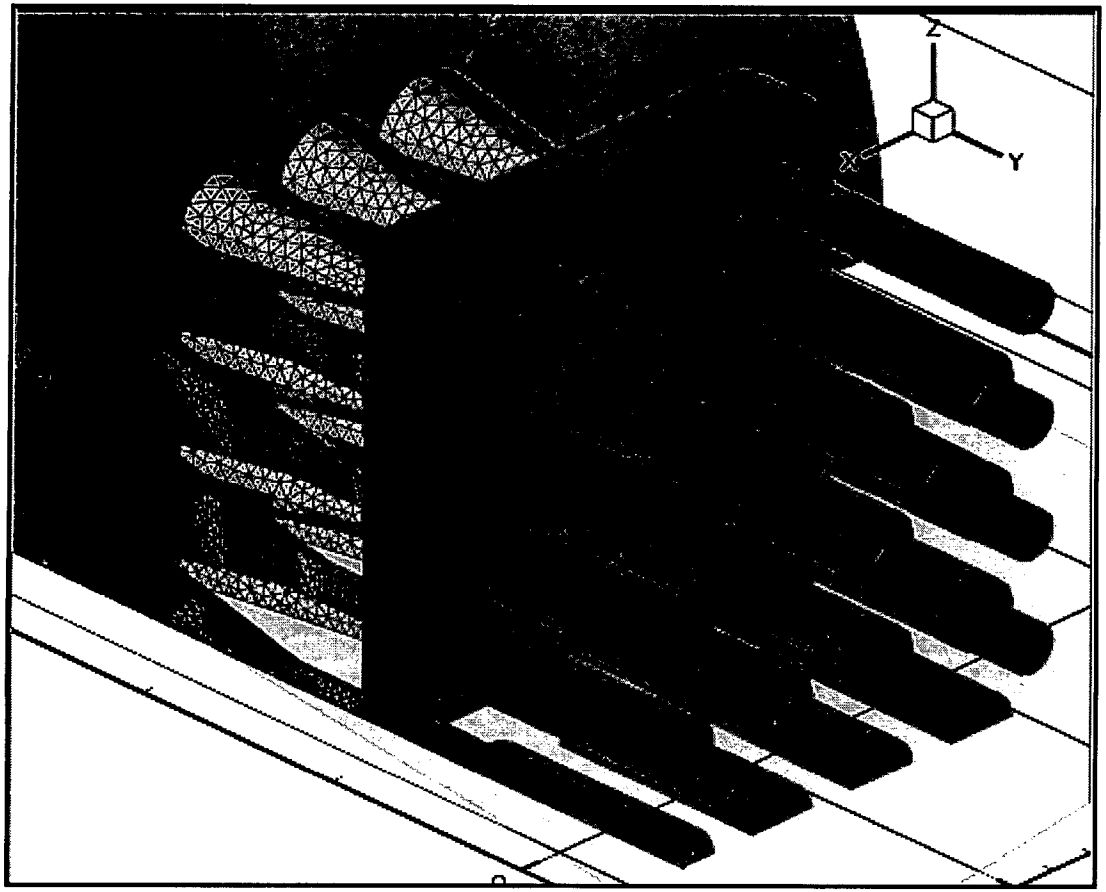
FIG. 7 illustrates a computational grid used to model the premixed burner flow passages, according to one embodiment of the present invention.
Figure 8:
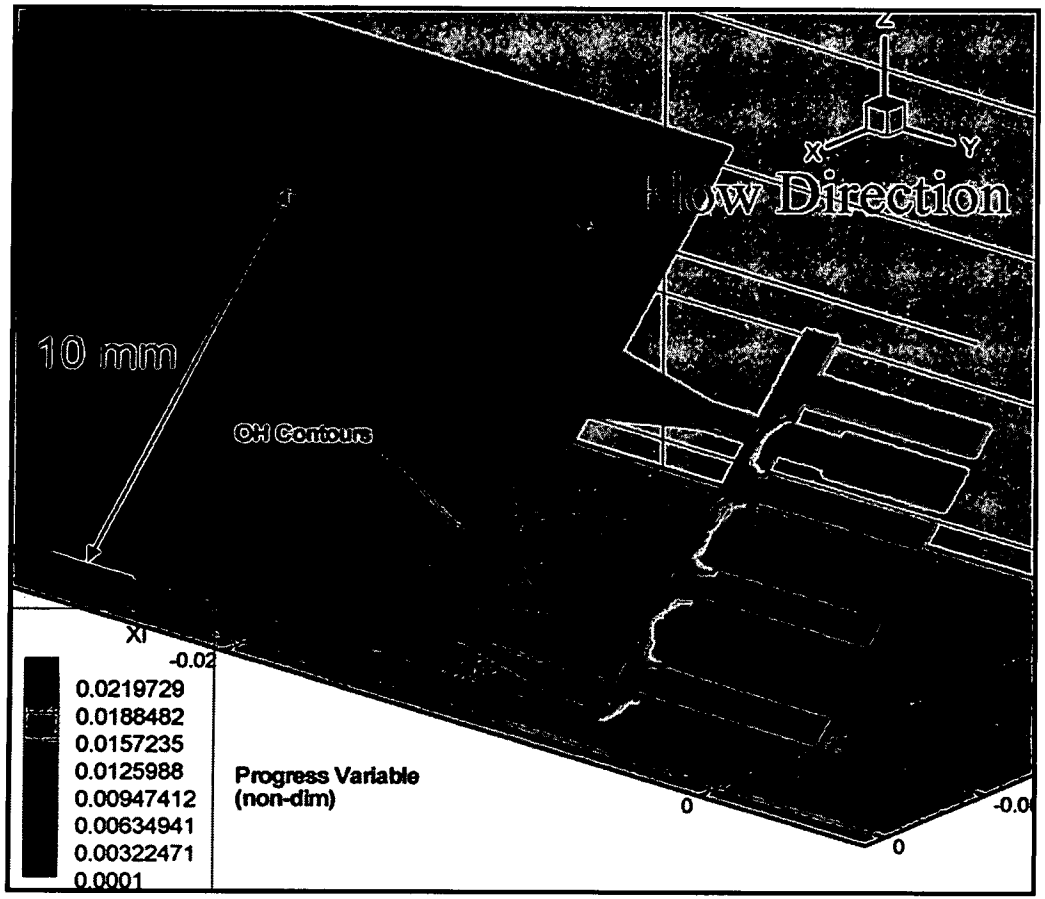
FIG. 8 illustrates the results of computational fluid dynamics analysis with hydrogen-air chemistry, according to one embodiment of the present invention.

In order to estimate the effectiveness of the premixing of the fuel-oxidizer mixtures with this burner design, the chemically reacting flows were modeled through this burner using a computational fluid dynamics (CFD) software package that includes chemistry. FIG. 7 shows the grid that was used to model the flow passages through the burner. FIG. 8 shows the results from a simulation using a simplified $H_2$-air mechanism. In FIG. 8, the progress variable contours for a fuel-lean case (Phi=0.5) is shown. The progress variable is defined to be equal to 1 for pure fuel and 0 for pure air and is an indicator of the extent of fuel-air mixing. It should be noted that the excellent mixing performance predicted by software for this burner design. Furthermore, the software model predicts that the flame is stabilized on the burner surface and the combustion is completed within 4 mm of the burner surface.

Figure 9:
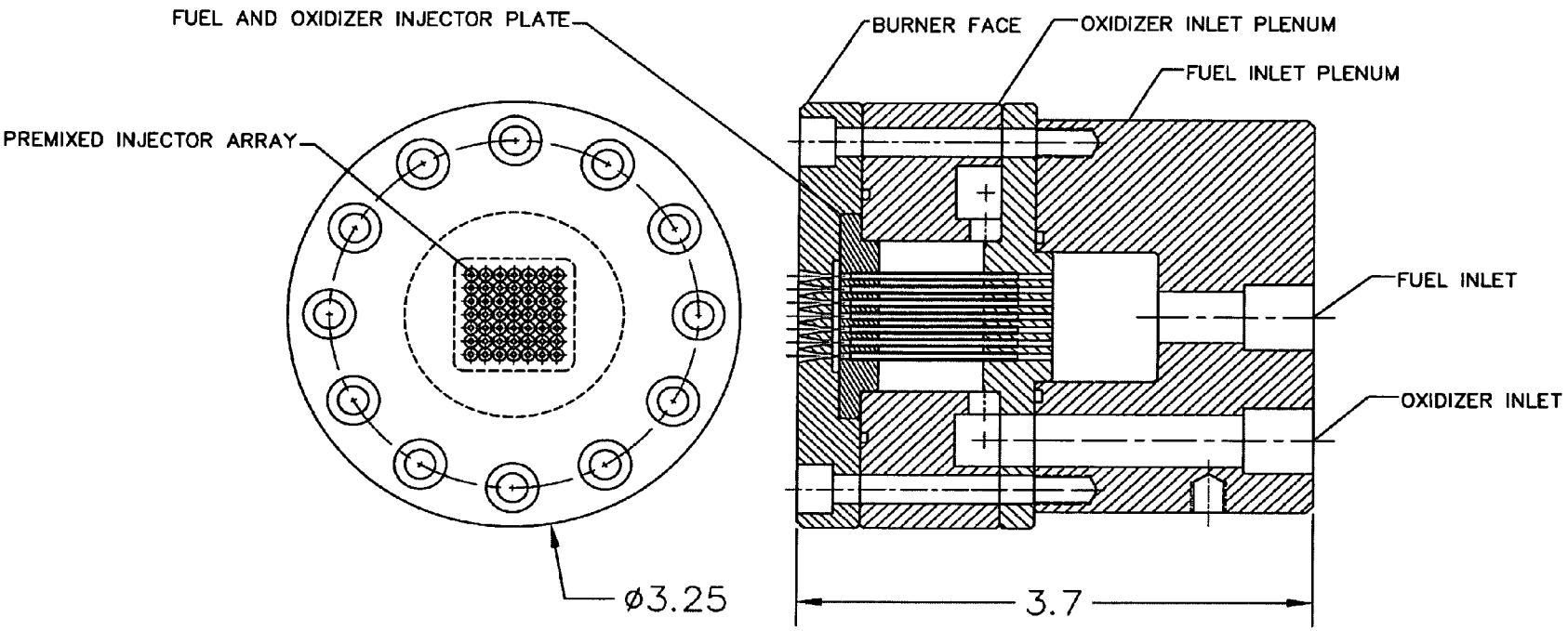
FIG. 9 illustrates an alternate multi-fuel burner assembly, according to one embodiment of the present invention.

An alternate embodiment of the present invention is also illustrated in FIG. 9, showing an assembly diagram. This particular design uses a 7×7 array of premixed exit jets with a 7×7 array of fuel jets and an 8×8 array of oxidizer jets. The fuel and oxidizer jets are 0.042 in (1.07 mm) diameter holes, the premixed jets are 0.035 in (0.889 mm) diameter holes expanding in a 1:5 area ratio; all the holes are spaced 1.025 in (2.60 mm)×1.025 in (2.60 mm) apart in a square patterned array, with the fuel and air holes offset by half the spacing as shown in FIG. 1. The spacing of the premixing chamber gap between the injector holes and the exit jet holes is 0.050 in (1.27 mm). The overall diameter of the assembly is 3.25 in (82.6 mm). All of the jets were fabricated by conventional drilling in oxygen-free copper burner material to provide enhanced heat transfer for effective self-cooling. Designs were also tested using 300 series stainless steel for the burner face and operated well at equivalence ratios below Phi=0.6 without thermal meltdown problems.

The burner has been tested at pressures ranging from 1.2 bar to 30 bar over a wide range of operating conditions. At equivalence ratios below Phi=0.6 the burner can be operated indefinitely without thermal problems. However at more fuel rich equivalence ratios, there is a limited operation time due to excess heat buildup. This would only be a durability problem if the burner were not used for a low-emissions burner which typically operates at equivalence ratios well below Phi=0.6. The burner has been tested several times for periods of about 1 hour at a time. Since the original purpose of this burner was to serve as a research calibration burner, no long term operational studies were performed. However, based on the fact that the materials are composed of stainless steel and copper, it is expected that the burner should be robust and reliable for long-term use.

The present invention allows for ultra-low emissions combustion when operated fuel-lean, good mixing of fuel and air, a true fully-premixed design, thermal management using impingement cooling, low pressure drop (<7%) uniform combustion zone, a scalable design can be made small or large depending on requirements, multi-fuel capability, rugged and easy to operate, and a simple design that is easy to fabricate using either conventional methods or advanced methods using metal diffusion bonded laminate technologies.

The present invention provides for the ability to operate in a fully-premixed mode with hydrogen-air, does not suffer from flashback, does not suffer from thermal meltdown at fuel lean equivalence ratios, does not have combustion instability problems, compact design afforded by good mixing which keeps flame zone short, short design can save weight and costs due to reduced physical size.

Tests were performed on the burner design using hydrogen/air mixtures in a high pressure flame tube facility with optical access and advanced laser diagnostics. The flow rates were varied to operate the burner over a wide equivalence ratio ranging from Phi=0.15 to Phi=5 and pressures ranging from 1.2 bar to 30 bar. The burner was found to operate reliably and in a stable regime over the entire Phi range. However, at equivalence ratios above Phi=0.6 and below Phi=2.0, the burner could only be operated for less than 2 minutes before the burner face temperatures get too hot (650 C). Table 1 shows the actual measured operating conditions tested for this burner operating on hydrogen-air mixtures at 10 bar pressure.

TABLE 1

| FAR | PHI | P (psia) | dP/P (%) | AIR (SLM) | $H_2$ (SLM) |
|---|---|---|---|---|---|
| 0.2275 | 0.542 | 149.4 | 6.06% | 326.68 | 74.33 |
| 0.1782 | 0.424 | 148.9 | 6.14% | 327.84 | 58.41 |
| 0.1395 | 0.332 | 148.6 | 6.37% | 327.86 | 45.75 |
| 0.0818 | 0.195 | 148.6 | 6.78% | 327.82 | 26.81 |
| 0.0675 | 0.161 | 148.6 | 7.01% | 327.84 | 22.14 |
| 0.2508 | 0.597 | 149.5 | 6.02% | 327.69 | 82.18 |
| 0.3205 | 0.763 | 149.2 | 5.85% | 327.95 | 105.11 |
| 0.3446 | 0.820 | 149.1 | 6.66% | 259.30 | 89.36 |
| 0.4346 | 1.034 | 149.6 | 6.46% | 258.99 | 112.56 |
| 0.5267 | 1.254 | 152.8 | 4.97% | 325.92 | 171.66 |
| 0.5940 | 1.414 | 150.9 | 4.28% | 325.93 | 193.62 |
| 0.5941 | 1.414 | 150.9 | 4.12% | 325.99 | 193.67 |
| 0.7891 | 1.878 | 151.3 | 5.31% | 260.20 | 205.31 |
| 0.8651 | 2.059 | 151.1 | 5.40% | 237.39 | 205.35 |
| 1.3326 | 3.172 | 151.2 | 6.71% | 154.01 | 205.23 |
| 1.0704 | 2.548 | 151.1 | 6.01% | 191.82 | 205.32 |
| 1.4941 | 3.556 | 151.2 | 6.94% | 137.39 | 205.27 |
| 1.7818 | 4.241 | 149.9 | 7.04% | 115.19 | 205.24 |
| 2.0851 | 4.963 | 150.6 | 7.42% | 98.46 | 205.29 |

Although this seems like a problem, in practice, for low-emissions operation, the burner will be operated at fuel lean equivalence ratios well below Phi=0.6, typically around Phi=0.3. It is expected that at fuel lean equivalence ratios where the flame temperature is kept below 1700 K, there is very little production of nitric oxide (NO) through the thermal $NO_X$ mechanism which is the predominant source of $NO_X$ emissions for combustion systems which use air as the oxidizer.

While the above discussion has been concerned with fuel gases, the present invention is also applicable to the use of liquid fuels. In such alternate embodiments, a liquid atomizer nozzle is coaxially-located with the exit nozzle. The atomizer could be any typical design such as a 'Simplex' type. The use of the atomizer would produce a fuel gas and the overall function of the burner would be similar.

Although the invention has been described based upon these preferred embodiments, it would be apparent to those skilled in the art that certain modifications, variations, and alternative constructions would be apparent, while remaining within the spirit and scope of the invention. In order to determine the metes and bounds of the invention, therefore, reference should be made to the appended claims.

The invention claimed is:

1. A low-emissions high-pressure multi-fuel burner comprising:

a fuel inlet, for receiving a fuel;

an oxidizer inlet, for receiving an oxidizer gas;

an injector plate, having a plurality of nozzles that are aligned with premix face of the injector plate, the plurality of nozzles in communication with the fuel and oxidizer inlets and each nozzle providing flow for one of the fuel and the oxidizer gas; and an impingement-cooled face parallel to the premix face of the injector plate; and a micro-premix chamber formed between the impingement-cooled face and the injector face, wherein the fuel and the oxidizer gas are mixed in the micro-premix chamber through impingement-enhanced mixing of flows of the fuel and the oxidizer gas.

2. The low-emissions high-pressure multi-fuel burner as recited in claim 1, wherein the impingement-cooled face causes the flow of one gas of the fuel and oxidizer gases to turn 90° and mix into the other gas of the fuel and oxidizer gases at a direction that is perpendicular to the flow of the other gas.

3. The low-emissions high-pressure multi-fuel burner as recited in claim 1, wherein burner is configured such that the one gas is the oxidizer gas.

4. The low-emissions high-pressure multi-fuel burner as recited in claim 1, wherein the injector plate further comprises final exit jet nozzles, where the final exit jet nozzles are coaxial with at least some of the plurality of nozzles.

5. The low-emissions high-pressure multi-fuel burner as recited in claim 1, wherein the plurality of nozzles are staggered in their placement on the injector plate.

6. The low-emissions high-pressure multi-fuel burner as recited in claim 5, where the plurality of nozzles are positioned in an array pattern on the injector plate.

7. The low-emissions high-pressure multi-fuel burner as recited in claim 1, wherein the fuel is hydrogen gas and the oxidizer gas is air and the burner is configured burn the hydrogen and air without flashback.

8. The low-emissions high-pressure multi-fuel burner as recited in claim 1, wherein the burner is configured to produce approximately zero $NO_X$ in the burning of the fuel and oxidizer gases.

9. The low-emissions high-pressure multi-fuel burner as recited in claim 1, wherein the impingement-cooled face is composed of oxygen-free copper or a high temperature alloy.

10. The low-emissions high-pressure multi-fuel burner as recited in claim 9, wherein the impingement-cooled face is coated with a ceramic-spray-deposited temperature barrier coating.

11. A method of burning fuels at low-emissions and high-pressure, the method comprising the steps of:

receiving a fuel at a fuel inlet;

receiving an oxidizer gas at an oxidizer inlet;

providing the fuel and the oxidizer gas to a plurality of nozzles of an injector plate, with the plurality of nozzles being aligned with premix face of the injector plate, with different nozzles receiving the fuel and oxidizer gases; and mixing the fuel and the oxidizer gas in a micro-premix chamber, formed between the injector plate and an impingement-cooled face, through impingement-enhanced mixing of flows of the fuel and the oxidizer gas;

wherein the impingement-cooled face causes the flow of one of the fuel and the oxidizer gas to turn 90° and mix into the other of the fuel and the oxidizer gas at a direction that is perpendicular to the flow of the other.

12. The method as recited in claim 11, wherein the one is the oxidizer gas.

13. The method as recited in claim 11, wherein the providing step comprises providing the fuel and the oxidizer gas through the plurality of nozzles which are staggered in their placement on the injector plate.

14. The method as recited in claim 13, where the plurality of nozzles are positioned in an array pattern on the injector plate.

15. The method as recited in claim 11, wherein the fuel is hydrogen gas and the oxidizer gas is air and the method is performed without flashback.

16. The method as recited in claim 11, wherein the method produces approximately zero $NO_X$ in the burning of the fuel and the oxidizer gas.

17. A system for burning fuels at low-emissions and high-pressure, comprising:

first receiving means for receiving a fuel at a fuel inlet;

second receiving means for receiving an oxidizer gas at an oxidizer inlet;

providing means for providing the fuel and the oxidizer gas to a plurality of nozzles of an injector plate, with the plurality of nozzles being aligned with premix face of the injector plate, with different nozzles receiving the fuel and the oxidizer gas; and mixing means for mixing the fuel and the oxidizer gas in a micro-premix chamber, formed between the injector plate and an impingement-cooled face, through impingement-enhanced mixing of flows of the fuel and the oxidizer gas;

wherein the impingement-cooled face causes the flow of one of the fuel and the oxidizer gas to turn 90° and mix into the other of the fuel and the oxidizer gas at a direction that is perpendicular to the flow of the other.

18. The system as recited in claim 17, wherein the one is the oxidizer gas.

19. The system as recited in claim 17, wherein the providing means comprises means for providing the fuel and the oxidizer gas through the plurality of nozzles which are staggered in their placement on the injector plate.

20. The system as recited in claim 19, where the plurality of nozzles are positioned in an array pattern on the injector plate.

21. The system as recited in claim 17, wherein the impingement-cooled face is composed of oxygen-free copper.

22. The system as recited in claim 21, wherein the impingement-cooled face is coated with a ceramic-spray-deposited temperature barrier coating.

* * * * *